US005522185A

United States Patent [19]

Cline

[11] Patent Number: 5,522,185

[45] Date of Patent: Jun. 4, 1996

[54] SNOW STOP

[75] Inventor: Roger M. Cline, Bluemont, Va.

[73] Assignee: Real-Tool, Inc., Purcellville, Va.

[21] Appl. No.: 456,423

[22] Filed: Jun. 1, 1995

Related U.S. Application Data

[63] Continuation of Ser. No. 141,558, Oct. 27, 1993, abandoned, which is a continuation-in-part of Ser. No. 879,269, May 7, 1992, Pat. No. 5,282,340.

[51] Int. Cl.[6] ..... E04D 13/10

[52] U.S. Cl. ..... 52/24; 52/26

[58] Field of Search ..... 52/24–26

[56] References Cited

U.S. PATENT DOCUMENTS 595,295 12/1897 Fox et al. ..... 52/24
1,095,822 5/1914 Danzer ..... 52/25
5,271,194 12/1993 Drew .
5,282,340 2/1994 Cline et al. ..... 52/24

*Primary Examiner*—Lanna Mai
*Attorney, Agent, or Firm*—James Creighton Wray

[57] ABSTRACT

A snow stop has a flat blade formed with curved upper and lower edges. Openings extend through the blade for weight reduction and for permitting passage of air and fluids. A slot extends upward from a center of a blade for receiving a standing seam of a metal roof, and a boss extends from the blade around the slot for fixing the blade on a roof seam. The boss has an outward extending support with a ledge, which continues outward from a top of the slot for resting on top of a standing seam. The boss extends downward and terminates downwardly in rounded lobes. Holes extend through the lobes parallel to the blade, and fasteners extend through the holes for engaging sides of a standing seam. The fasteners cooperate with the ledge to prevent movement of the snow stop on the seam.

29 Claims, 2 Drawing Sheets

SNOW STOP

This application continuation of Ser. No. 08/141,558, filed Oct. 27, 1993, abandoned, is a continuation-in-part of application Ser. No. 07/879,269, filed May 7, 1992, now U.S. Pat. No. 5,282,340, issued Feb. 1, 1994.

BACKGROUND OF THE INVENTION

Metal roofs with standing seams have been in long use in the United States and throughout the world.

The metal roofs have the advantage of being long lasting and light in weight. The roofs are popular for use on soaring, expensive structures such as churches and cathedrals. Standing seam roofs have been widely used on rural buildings such as barns and houses where low maintenance, long lasting and lightness qualities have been greatly appreciated.

The long lasting qualities of standing seam roofs may be appreciated when driving through rural areas and seeing old structures which have not been maintained still standing and still in good structural shape because of the integrity of the standing seam metal roofs.

Standing seam metal roofs have come into wide favor in the United States, Europe and in other countries on new public and private buildings and on upscale houses.

One problem of standing seam roofs which is in part responsible for their long lasting qualities and protection of the structures on which the roofs are placed is that accumulated snow and ice readily slides from the roofs in large chunks, which are capable of damaging shrubbery planted near the structures.

To avoid the sliding of large coherent pieces of snow and ice from the roofs, snow stops are employed.

Great care must be exercised in the design and placement of snow stops to ensure that the snow stops do not violate the integrity of the roof, and that the snow stops do not provide dams for accumulating water and debris behind the snow stops, which might be sufficient to create acidic cells to adversely act upon the roofing.

One of the problems in designing snow stops is that standing seam roofs have many different seam configurations, which must be accommodated by the snow stops.

SUMMARY OF THE INVENTION

The present invention provides a snow stop which overcomes problems existing in the prior art. The snow stop of the invention does not violate watertight integrity of the standing seam roofs because the snow stop rests lightly upon the standing seam roofs, and is secured against movement by fasteners which clamp on the seam without penetrating the seam.

The snow stops of the present invention are created for accommodating a number of seams independently of the width of the seams for the shapes of the seams, which may have wide tops and relatively narrow upstanding portions.

A snow stop has a flat blade formed with curved upper and lower edges. Openings extend through the blade for weight reduction and for permitting passage of air and fluids. A slot extends upward from a center of a blade for receiving a standing seam of a metal roof, and a boss extends from the blade around the slot for fixing the blade on a roof seam. The boss has an outward extending support with a ledge, which continues outward from a top of the slot for resting on top of a standing seam. The boss extends downward and terminates downwardly in rounded lobes. Holes extend through the lobes parallel to the blade, and fasteners extend through the holes for engaging sides of a standing seam. The fasteners cooperate with the ledge to prevent movement of the snow stop on the seam.

A snow stop a blade for extending across a slope of standing seam metal roof. A slot extends upward from a bottom of the blade. Bosses project forward from the blade along the slot. The bosses have large lower ends. Holes extend through the large open ends parallel to the blade. Fasteners extend through the holes for clamping on a standing seam of the roof. A foot extends outward from between the bosses adjacent the slot for resting on top of the standing seam and supporting the blade on the seam against rotation around the fasteners.

Legs project forward from the bosses and the foot projects across the legs.

The bosses are generally triangular in profile and extend downward from narrow parts near a top of the blade to wide parts near a bottom of the blade. The wide parts are rounded and are radiused around axes of the holes. The holes are near a bottom of the plate.

A snow stop has a blade and a mount. A roof seam is centered in the blade. The blade has lateral sections extending upward and outward from the mount and a generally rectangular central slot extending upward from a base of the blade. The mount is joined to the blade and surrounds the slot. The mount has a support with a ledge extending outward from the blade at a top of the slot for resting on a top of a standing seam on a roof. Legs extend from the blade on opposite sides of the slot. Holes extend through the legs parallel to the blade, and fasteners extend through the holes for engaging sides of a standing seam.

The ledge holds the blade in fixed angular alignment with the seam, and the fasteners prevent sliding of the plate along the seam.

The support, ledge and legs are formed as a boss extending forward from the blade in a direction of the downward slope of a roof.

These and further and other objects and features of the invention are apparent in the disclosure, which includes the above and ongoing written specification, with the claims and the drawings.

DETAILED DESCRIPTION OF THE DRAWINGS

Figure 1:
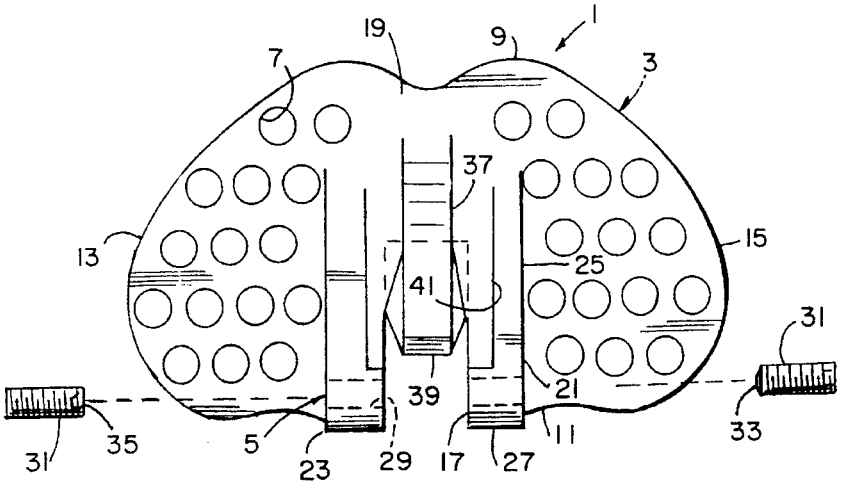
FIG. 1 is a front elevation of a preferred snow stop of the invention.

Referring to FIG. 1, a snow stop is generally indicated by the numeral 1. The snow stop has a blade 3 and a mounting boss 5. Openings 7 extend through the blade to reduce weight and provide for the passage of air and water. The blade has a top 9 and a base 11 and sides 13 and 15. A slot 17 extends upward from the base 11 of the blade.

The mounting boss 5 has bosses or legs 21 which extend outward and downward from a front face 19 along slot 17. The opposite up-slope face 18 of the blade is substantially flat and is shown in FIG. 2.

The lower portions 23 of the bosses 21 are relatively large with respect to the upper tapered portions 25, and the lower portions are rounded 27 on an axis of the holes 29, which extend through the lower portions. Set screw fasteners 31 are provided for engaging the threaded holes 29 to clamp the roof seam. One fastener has a rounded convex end 33, and the opposite fastener has a concave end 34 for cooperating in bending and deforming upstanding portions of the roof seams to prevent sliding of the fasteners and snow stop along the roof under loaded conditions. Ends of the set screws are formed with hex cavities to receive wrenches for tightening the screws on a seam.

A central projection 37 extends from the bosses and supports a ledge 39 in the middle of the slot 17 for resting on the cap of a roof seam. Extended legs 41 extend outward from the bodies of bosses 21 to support the extension 37 and ledge 39.

Figure 2:
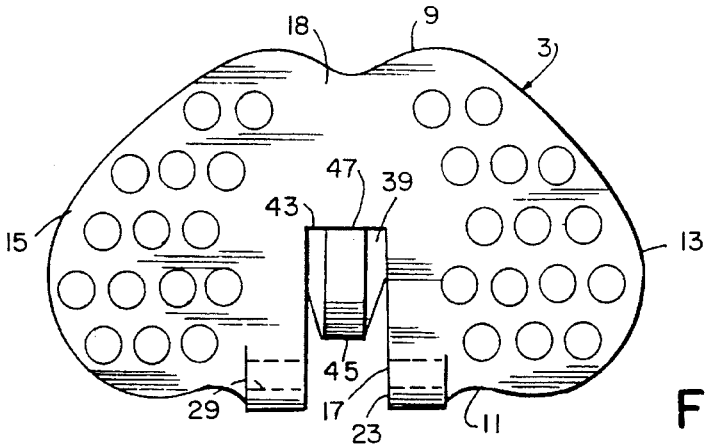
FIG. 2 is a rear elevation of the snow stop shown in FIG. 1.

As shown in FIG. 2, the ledge 39 is a substantially flat surface which extends from the top 43 of the slot 17 to an end 45 of the central extension. A recessed groove 47 may be formed in the center of ledge 39 to center the ledge 39 on narrow seam caps and to provide a channel for flowing water along the center of wider seam caps.

Figure 3:
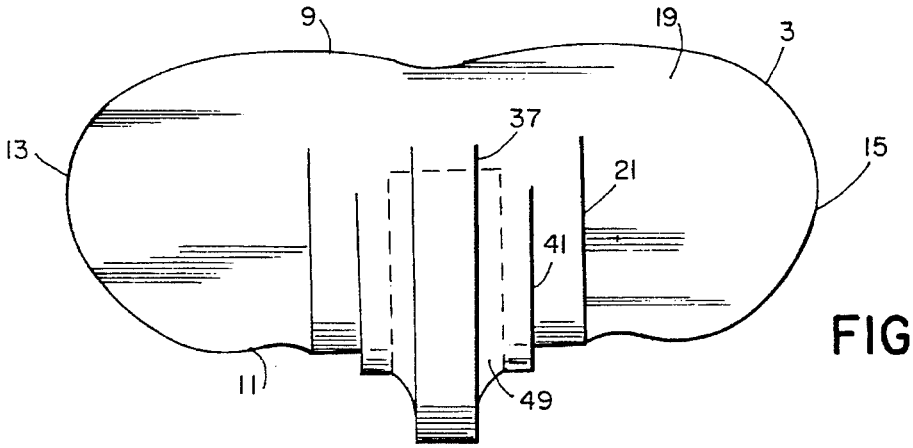
FIG. 3 is a top view of the snow stop taken along a plane of the seam on which the snow stop rests.

FIG. 3 is a top view taken along a plane of a roof and a plane of a seam cap on which the snow stop 1 would be mounted. Openings 7 have been omitted from FIGS. 3, 4 and 5 to emphasize the details of the blade and mounting boss. The blade surface 19 is shown at an angle to the plane of the drawing. The boss 21, the leg extensions 41 and the support projection 37 also extend at an angle to the drawings. The triangular support areas 49 which extend between the support projection 37 and the support legs 41 are clearly shown in the top view of FIG. 3.

Figure 4:
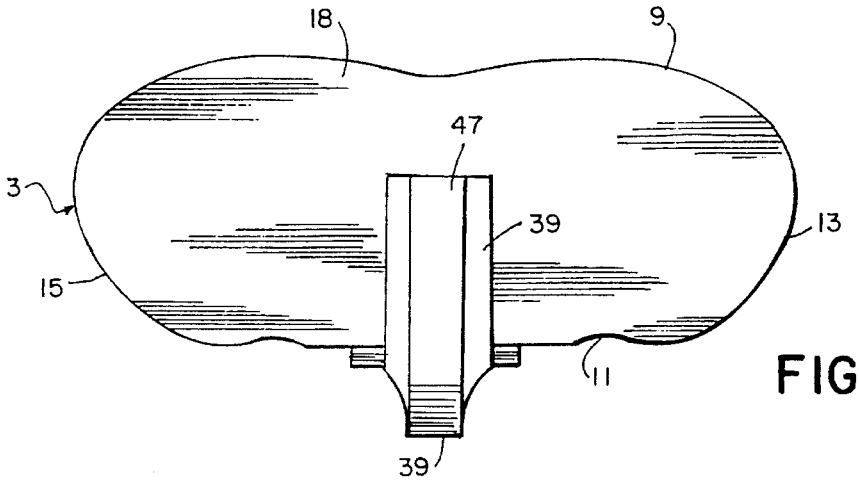
FIG. 4 is a bottom view of the snow stop parallel to the plane of a top of the seam on which the snow stop rests.

The bottom view in FIG. 4 shows the blade 3 and surface 18, and shows the slot 17. The ledge 39 and the central groove 47, which rests on a cap of a seam, are shown in their true configuration in the plane of the drawing in FIG. 4. Bosses 21 extend partially beyond the blade.

Figure 5:
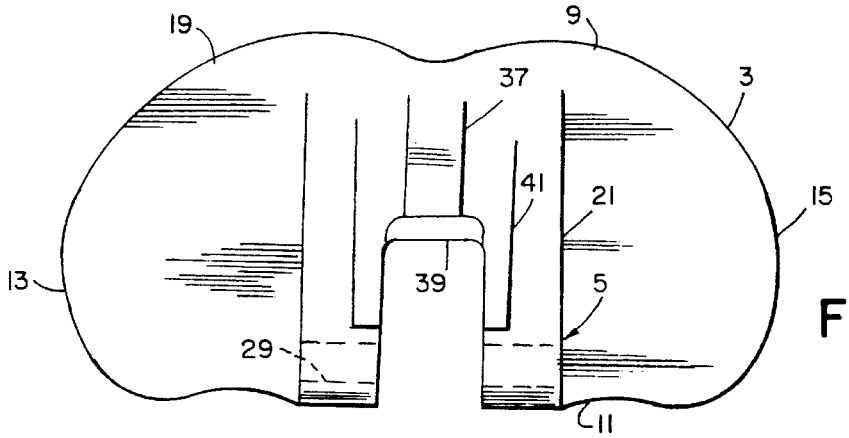
FIG. 5 is a shank view of the snow stop perpendicular to a plane of the top of the seam on which the snow stop rests. Openings in the blades of FIGS. 3, 4 and 5 have been omitted to focus on details of the mount.

In the shank view shown in FIG. 5, the blade surface 19 is visible. The plane of the drawing is perpendicular to a roof seam, and the ledge 39 is shown as a straight line which lies on the cap of the roof seam centered in the blade 19. Bosses 21 and leg extensions 41 are shown foreshortened because of the angular relation of the blade.

Figure 6:
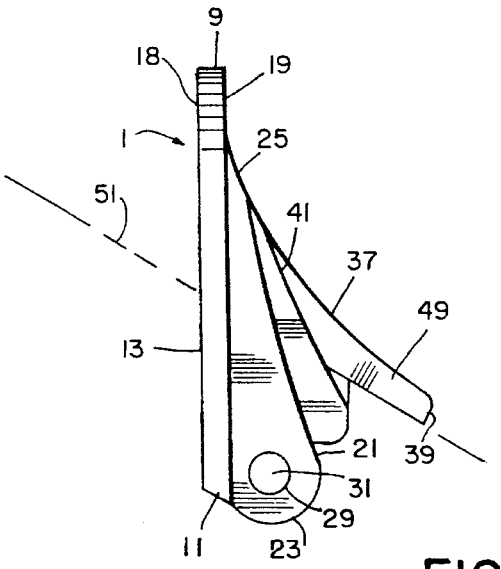
FIG. 6 is a side elevation of the snow stop. The opposite side is substantially identical and in mirror image.

In the right side elevation of FIG. 6, blade 3 is shown with its top 9 and base 11 and right side 13. The front face 19 faces down the roof slope, and the rear face 18 faces up-slope in relation to the roof. The slope of the roof is generally indicated by the line 51, which represents the top of the seam. The boss 21 and leg extension 41, and the triangular area 49 which supports the extension 37 and ledge 39, are generally shown in FIG. 6. When the roof has a lesser slope, the blade 3 may tilt to the left. On the roof of a greater slope, the blade 3 may tilt to the right.

The hex headed set screw fasteners 31 mounted in the holes 29 connect the snow stop to the standing portions of the roof seam, and the ledge 39 rests atop the cap of the roof seam. The fasteners 31 prevent the snow stop from sliding along the roof seam, and the ledge 39 holds the angular relation of the snow stop and the roof seam.

Figure 7:
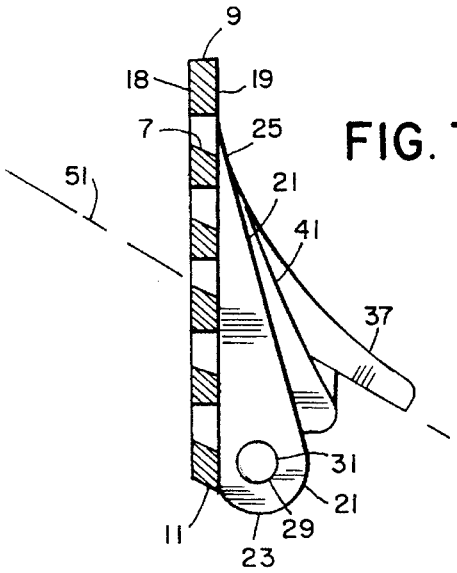
FIG. 7 is a cross-sectional side elevation showing the openings through the blade.

In FIG. 7, the blade is shown in cross-section in the side elevation. Holes 7 are shown tapered. However, the holes 7 may have straight walls.

While the invention has been described with reference to specific embodiments, modifications and variations of the invention may be constructed without departing from the scope of the invention, which is defined in the following claims.

I claim:

1. A snow stop having a blade for extending across a slope of standing seam metal roof, a slot extending upward from a bottom of the blade, bosses projecting forward from the blade along the slot, the bosses having large lower ends, holes extending through the large open ends parallel to the blade, fasteners extending through the holes for clamping on a standing seam of the roof, and a foot extending outward from between the bosses adjacent the slot for resting on top of the standing seam and supporting the blade on the seam against rotation around the fasteners.

2. The snow stop of claim 1, further comprising legs projecting forward from the bosses and the foot projecting across the legs.

3. The snow stop of claim 1, wherein the bosses are generally triangular in profile and extend downward from narrow parts near a top of the blade to wide parts near a bottom of the blade.

4. The snow stop of claim 3, wherein the wide parts are rounded.

5. The snow stop of claim 4, wherein the wide parts are radiused around axes of the holes.

6. The apparatus of claim 5, wherein the holes are near a bottom of the plate.

7. The apparatus of claim 1, wherein the holes are opposed threaded holes and the fasteners are opposed set screws extending through the threaded holes.

8. The apparatus of claim 7, wherein the set screws have inward ends which are a rounded convex end and a concave end respectively.

9. The apparatus of claim 7, wherein a top of the slot rests on a top of a seam and wherein the opposed holes and opposed fasteners are generally centered under the top of the slot.

10. A snow stop comprising a blade and a mount a roof seam centered in the blade, the blade having lateral sections extending upward and outward from the mount and having a generally rectangular central slot extending upward from a base of the blade, the mount being joined to the blade and surrounding the slot, the mount further comprising a support having a ledge extending outward from the blade at a top of the slot for resting on a top of a standing seam on a roof, legs extending from the blade on opposite sides of the slot, holes extending through the legs parallel to the blade, and fasteners extending through the holes for engaging sides of a standing seam.

11. The snow stop of claim 10, wherein the ledge holds the blade in fixed angular alignment with the seam, and wherein the fasteners prevent sliding of the plate along the seam.

12. The snow stop of claim 11, wherein the support, ledge and legs are formed as a boss extending forward from the blade in a direction of the downward slope of a roof.

13. A snow stop comprising a flat blade formed with curved upper and lower edges, and openings extending through the blade for weight reduction and for permitting passage of air and fluids, a slot extending upward from a center of the lower edge of the blade for receiving a standing seam of a metal roof, a mounting boss extending outward from the blade around the slot for fixing the blade on a roof seam, the boss having an outward extending support with a ledge, which continues outward from a top of the slot for resting on top of the seam, the boss extending downward and terminating downwardly in rounded lobes, holes extending through the lobes parallel to the blade, and fasteners extending through the holes for engaging sides of the seam, the fasteners cooperating with the ledge to prevent movement of the snow stop on the seam.

14. The apparatus of claim 13, wherein the holes are opposed threaded holes and the fasteners are opposed set screws extending through the threaded holes.

15. The apparatus of claim 14, wherein the set screws have inward ends which are a rounded convex end and a concave end respectively.

16. The apparatus of claim 14, wherein a top of the slot rests on a top of a seam and wherein the opposed holes and opposed fasteners are generally centered under the top of the slot.

17. A snow stop apparatus comprising a clamp for engaging a standing seam of a metal roof and holding a snow stop attached to the standing seam, the clamp comprising a body having first and second legs for positioning on opposite sides of a standing seam, first and second threaded holes in the first and second legs respectively normal to the standing seam, first and second screw fasteners inserted in the first and second threaded holes respectively, the first and second screw fasteners having outer ends configured for turning with wrenches and having opposed inner ends with opposite a complementary recess in one inner end and a projection in an opposite inner end for cooperating in deforming material of the standing seam into the recess with the projection.

18. The snow stop of claim 17, wherein the fasteners prevent sliding of the plate along the seam.

19. A snow stop apparatus for mounting a blade extending across a slope of standing seam metal roof, comprising a body having a slot extending upward from a bottom of the body, bosses projecting from the body along the slot, the bosses having large lower ends, holes extending through the large lower ends parallel to the blade, opposed set screw fasteners extending through the holes for clamping on a standing seam of the roof, the fasteners having outer ends for engaging wrenches and having opposite complementary inner ends with a projection in one fastener inner end for pressing a portion of a roof seam and an opposite recess in the opposite fastener inner end for receiving a pressed portion of the roof seam.

20. The apparatus of claim 19, wherein the holes are near a bottom of the body.

21. The snow stop of claim 19, wherein the fasteners prevent sliding of the plate along the seam.

22. A snow stop apparatus comprising a mount for a blade, a roof seam centered in the mount and having a generally rectangular central slot extending upward from a base of the mount, the mount surrounding the slot, legs extending from the mount on opposite sides of the slot, threaded holes extending through the legs normal to the standing seam and threaded fasteners extending through the threaded holes for engaging sides of a standing seam, the fasteners having outer ends for engaging wrenches and having opposite complementary inner ends, one inner end having a recess for receiving a pressed portion of the roof seam, and one inner end with a projection for forcing metal from the roof seam into the recess.

23. The snow stop of claim 22, wherein the complementary recess and projection in inner ends of the fasteners prevent sliding of the plate along the seam.

24. A snow stop comprising a body, a slot extending upward from a center of a lower edge of the body for receiving a standing seam of a metal roof, a mounting boss extending outward from the body around the slot for fixing the body on a roof seam, the boss having an outward extending support with a ledge, which continues from a top of the slot for resting on top of the seam, the boss extending downward and terminating downwardly in rounded lobes, threaded holes extending through the lobes normal to the seam, the threaded fasteners extending through the holes for engaging sides of the seam, the fasteners having outer ends for engaging wrenches and having opposite complementary inner ends with a projection for pressing a portion of a roof seam and a recess for receiving a pressed portion of the roof seam, the fasteners cooperating with each other to prevent movement of the snow stop on the seam.

25. The apparatus of claim 24, wherein the holes are near a bottom of the body.

26. The snow stop of claim 24, wherein the fasteners prevent sliding of the plate along the seam.

27. The apparatus of claim 24, wherein the fasteners are opposed set screws extending through the threaded holes.

28. The apparatus of claim 27, wherein the set screws having inward ends which are a rounded convex end and a concave end respectively.

29. The apparatus of claim 24, wherein a top of the slot rests on a top of a seam, and wherein the opposed holes and opposed fasteners are generally centered under the top of the slot.

* * * * *